United States Patent [19]

Domingue, Sr. et al.

[11] Patent Number: 4,776,362

[45] Date of Patent: Oct. 11, 1988

[54] RELIEF VALVE FOR FLUID LINE

[76] Inventors: Chris J. Domingue, Sr.; Martin E. Postlethwait, both of P.O. Box 92971, Lafayette, La. 70509

[21] Appl. No.: 928,886

[22] Filed: Nov. 10, 1986

Related U.S. Application Data

[63] Continuation-in-part of Ser. No. 669,254, Nov. 7, 1984, abandoned.

[51] Int. Cl.[4] ..... E03B 7/10

[52] U.S. Cl. ..... 137/59; 137/318; 137/375; 137/543.19

[58] Field of Search ..... 137/59, 318, 375, 543.19

[56] References Cited

U.S. PATENT DOCUMENTS

| | | | |
|---|---|---|---|
| 1,022,171 | 4/1912 | Ballard | 137/543.19 |
| 1,108,840 | 8/1914 | Franke | 137/375 |
| 2,130,333 | 9/1938 | Allen | 137/318 |
| 4,556,082 | 12/1985 | Riley et al. | 137/375 |

FOREIGN PATENT DOCUMENTS

| | | | |
|---|---|---|---|
| 835072 | 2/1970 | Canada | 137/318 |
| 921735 | 2/1973 | Canada | 137/318 |

*Primary Examiner*—A. Michael Chambers
*Attorney, Agent, or Firm*—Pravel, Gambrell, Hewitt, Kimball & Krieger

[57] ABSTRACT

A pressure relief valve having an external valve body substantially cylindrical, with a bore therethrough positioned atop the exterior of the pipe, an internal stem portion movable within the bore within the valve body, including a tip for extruding in through a bore in the wall of the pipe, a piston member housed within the internal movable valve body movable from a first position locking fluid flow up through the internal body and a second position allowing fluid to enter the internal body and enter a drain port, a spring member intermediate the upper portion of the valve head and the internal body for biasing the piston member in a normally closed fluid bloding position, means on the valve body for imparting force on the upper portion of the internal member for driving the lower tip portion through the wall of a particular type of fluid flow pipe, and insulation means for housing the external valve and for insulating the valve from direct contact with the fluid flow line.

8 Claims, 3 Drawing Sheets

RELIEF VALVE FOR FLUID LINE

This application is a CIP of 06/669,254 filed 11/07/84, now abandoned.

BACKGROUND OF THE INVENTION

1. Field of the Invention

This invention concerns relief valves for placement in a fluid line to prevent cracking of the line when fluid therein freezes.

2. General Background

One of the most irritating aspects of cold weather is that exposed water pipes often freeze and crack. This cracking is caused by the expansion of water when it freezes to form ice. As the water expands within the confines of a water pipe, pressure builds within the pipe until it or associated structures rupture. Once ambient temperature rises to levels above freezing, the ice in the pipe melts yet a supply of running water to a building is not restored since the damaged pipe leaks.

It has previously been recognized that the internal pressure created by the freezing of water in the fluid line can be relieved by an inline pressure relief valve. U.S. Patents which have issued in this regard have been as follows:

U.S. Pat. Nos. 3,820,554; 2,205,463; 1,960,271; 1,876,938; 2,047,654; Great Britain Pat. No. 417; Canadian Pat. No. 447,072. These patents disclose pressure relief valves for fluid lines that open to release pressure at a preselected level. The prior art appreciates, that when water in a pipe freezes it freezes in those portions of the pipe adjacent the walls of the conduit. In other words, it has been found that water freezes in conduits from the outside of the interior, the water along the longitudinal axis of the conduit freezing last. However, the prior art fails to solve this problem.

The present invention recognizes this characteristic pattern of freezing in fluid lines and for the first time makes a successful attempt to solve this problem. The present inventors have accordingly provided a relief valve which projects into the fluid line being protected, and drains fluid out of the line from those portions of the line adjacent the conduit's longitudinal axis. This arrangement avoids the problems of the prior art in which previous relief valves were incapable of draining the fluid because they were situated adjacent the periphery of the conduit where water froze first. Placement of the relief valve adjacent the exterior of the conduit made it much more susceptible to being rendered inoperative by the water which froze initially near the walls of the conduit before the internal pressure in the conduit rose high enough to open the relief valve.

SUMMARY OF THE PRESENT INVENTION

The apparatus of the present invention solves the problems in the art in a simply and straightforward manner. What is provided is a pressure relief valve having an external valve body substantially cylindrical, with a bore therethrough positioned atop the exterior of the pipe; and an internal stem portion movable within the bore within the valve body, including a tip for extending in through a bore in the wall of the pipe, a piston member housed within the internal movable valve body movable from a first position blocking fluid flow up through the internal body and a second position allowing fluid to enter the internal body and enter a drain port, a spring member intermediate the upper portion of the valve head and the internal body for biasing the piston member in a normally closed fluid block closed position, means on the valve body for imparting force on the upper portion of the internal member for driving the lower tip portion through the wall of a particular type of fluid flow pipe, and insulation means for housing the external valve and for insulating the valve from direct contact with the fluid flow line. There is further provided a clamp member for engaging the valve in provided atop the fluid flow line to be adapted thereto.

DETAILED DESCRIPTION OF THE PREFERRED EMBODIMENT

Figure 1:
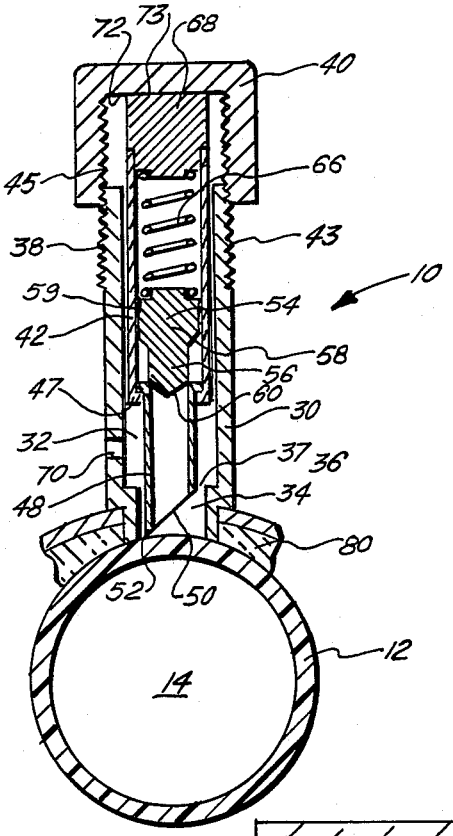
FIG. 1 is an overall side view of the preferred embodiment of the apparatus of the present invention.
Figure 2:
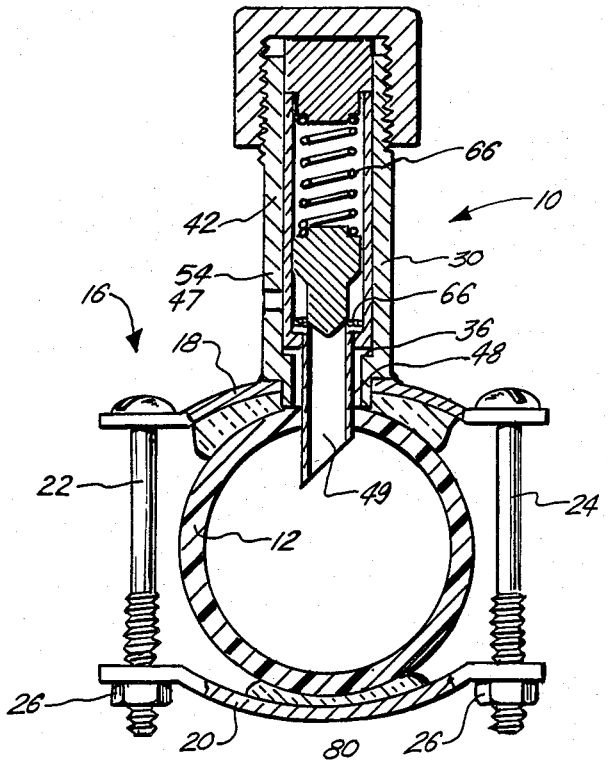
FIG. 2 is an overall side view of the apparatus of the present invention illustrating the piercing member through the wall of the pipe.
Figure 3:
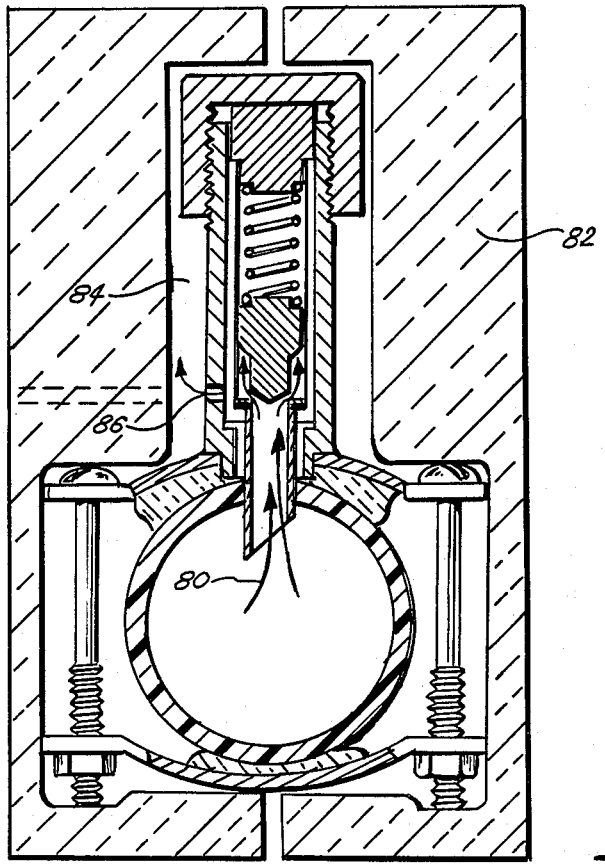
FIG. 3 is an overall cross-sectional view of the apparatus of the present invention illustrating the valve in position in a pipe during fluid flow with the insulation housing there around.

FIGS. 1–3 are illustrated in the preferred embodiment of the apparatus of the present invention by the numeral 10. As seen in the FIGS. 1—3, there is illustrated apparatus 10 situated upon a fluid flow line 12 such as a water pipe or the like, which may be exposed to external freezing temperatures. For purposes of illustration, this valve will be discussed in conjunction with a water pipe flowing beneath a structure, which is exposed to sub-freezing temperatures and may therefore tend to freeze and rupture through the expansion of fluid or water in the pipe. As seen in the FIGURES, pipe 12 includes a fluid flow bore 14 which is standard for allowing fluid flow such as water through the pipe to various parts of the structure. Apparatus 10 is positioned upon pipe 12 via a clamp member 16 which is a standard clamp having an upper clamping member 18 and a lower clamping member 20, both upper and lower clamping members of substantially similar curvature of pipe 12. Clamping members 18 and 20 are maintained in clamped position via screws 22 and 24 so that the tightening of nuts 26 imparts pressure upon clamping members 18 and 20 to engage around pipe 12 and for supporting apparatus 10 thereupon. The clamping members and the components of insulation will be discussed further.

For purposes of the invention, valve 10 would comprise an outer valve housing 30 which is substantially a cylindrical continuous wall portion having an internal bore 32 substantially therethrough with bore 32 ending into a narrow neck portion 34 at shoulder 36, having a sealing member 37 therebetween to seal off any fluid flow between neck portion 34 at shoulder 36. The upper external wall of housing 30 would comprise a series of threads 38, for accommodating valve cap 40 in position upon housing 30 as seen in FIGURE 1. Turning to the internal portion of valve 10, there is included a second driving member 42 which likewise comprises a substantially cylindrical housing through continuous wall portion 43 likewise having an internal bore 45 therewithin. Housing 42 on its lower end portion has a lower shoulder 47 for accommodating an extended piercing member 48, the piercing member 48 having a beveled edge 50 at its lower most end of providing a piercing point 52, the function of which will be discussed further. Housed within bore 45 of piercing member 42 there is included a piston member 54, having a lower body portion 56 and an upper broad body portion 58, with piston member 54 slidably movable within bore 45 of housing 42. It should be noted particularly in FIGS. 1 and 2, the lower most sealing face 60 of piston 54 is of such a width to sealingly engage the shoulder portion 47 at a gasket member 62 so that once in position there is a fluid seal established thereupon. Housed within the upper portion of bore 45, there is included a spring member 66 the upper most end of which is biased against internal cap 68 and the lower most end of which is biased against piston 54, so that spring 66 is biasing piston 54 normally in the position as seen in FIGS. 1 and 2.

For purposes of structure, it should be noted that piston 54 is slidably engaged within housing 42, so that, in the preferred embodiment, the wall 59 of piston 54 substantially creates a fluid tight seal between the internal face of the wall of housing 42 and wall portion 59 of piston 54 so that no fluid would be allowed to move from that portion of the housing below piston 56 to that portion of housing above piston 54 in that area of housing which would contain spring 66. However, in the event that the wall of housing 42 and wall portion 59 of piston 54 would not create a fluid tight seal, such as in the case of a industrial uses of the valve under high pressure, there could be included an O-ring 55 contained within a slot 57 in the wall portion 59 of piston 54, with the O-ring creating in fluid tight seal between itself and the wall of housing 42. Further, for purposes of structure, there is further included a fluid bleed port 70 in the wall of external housing 30, for allowing any fluid to bleed therefrom during use of the valve as will be discussed further.

As was discussed earlier, the functioning of valve 10 is directed primarily to a water pipe under a structure which is open to subfreezing temperatures and, due to the freezing nature of water, i.e., expanding upon freezing, it is utilized to allow bleeding off of water as it expands within pipe 14 so that rupture of the wall of pipe 12 does not occur.

In addition to the unique structure of valve 10, it is noted that valve 10 has a unique method of being applied to the pipe 12 as will be discussed at this point. In FIGS. 1 and 2, particularly FIG. 1, valve 10 has been set in position upon pipe 12 via clamp member 16 as seen in FIG. 2. However, upon the placement of valve 10 upon pipe 12, as seen in FIG. 1, piercing means 48 has been set in the upper most position with the point 52 resting on the exterior of the wall of pipe 12, so that the cap member 40 is slightly threadably engaged against the threads 38. As noted in the structure of the valve, upon the tightening of cap member 40, in the down position, as FIG. 2, the inner most face 72 of cap member 40 makes contact with the upper most face 73 of internal cap 68 and begins to drive housing 42, the lower portion of which comprises piercing member 48 down into the wall portion of pipe 12. As seen in FIG. 2, upon cap member 40 being completely threadably engaged upon external housing 30, piercing member 48 has been completely driven through the wall of pipe 12, so that the lower most shoulder portion 47 of housing 42 is engaged upon the shoulder portion 36 of outer housing 30. In addition, spring member 66 has biased piston member 54 into position to fluid tight engagement against gasket 62 resting on shoulder 47, and therefore any fluid flowing through the bore 14 of pipe 12 is unable to go beyond the face portion 60 of piston 54 while it is engaged in that position.

It should be noted that in this method of mounting valve member 10 upon pipe 12, this method can be utilized with only certain types of pipe, particularly plastic pipe, or copper tubing pipe. If galvanized pipe is utilized, then it would be necessary to first bore a hole through the wall of pipe 12, install valve member thereupon and then upon the tightening of cap member 40, piercing member 48 would enter through the bore in pipe 12 and into the position as seen in FIGS. 2 and 3.

One of the shortcomings found in the present state of the art in valves of this sort is the fact that upon the freezing of pipe 12, of course, the metal in pipe 12 would conduct the temperature through the wall of the pipe and up through the body portion of the valve and thus may cause freezing within the valve itself. In order to prevent this occurrence, there is included an insulation means 80 between the wall of pipe 12 and the upper and lower clamp members 18 and 20 so that no direct contact is made between the clamp members 18 and 20, the body portion of valve 10 and the pipe itself. Likewise, as seen in FIG. 3, since there is a possibility that the ambient atmosphere on very cold days would freeze the pipe, there is likewise included a body of insulation 82 which would be stirofoam or the like having an internal cavity 84 so that upon positioning of insulation 82 around valve 10, and pipe 12 is completely enclosed within insulation and therefore less susceptible to freezing.

Turning now to the functioning of valve 10, reference is made to FIG. 3 of the drawings. As is normal in the functioning of water pipes or the like, there is a predetermined pressure within the water pipes for example in the neighborhood of 35–50 PSI, that being the case, piston member 54 would normally be by-passed into the fluid tight position as seen in FIGS. 1 and 2 in fluid relationship with seat 66 during normal operation of the fluid line. Therefore, the fluid pressure within pipe 12 would not be sufficient to overcome the biasing of spring 66 at the poundage. However, as is known, upon the freezing of water in the pipe, the water would begin to expand and increase the pressure within pipe 14 and likewise the fluid pressure within the bore 49 of piercing member 48. That being the case, the pressure at that point would put sufficient pressure upon face 60 of piston 54 to overcome the biasing of spring 66 and move piston 54 to the up position as seen in FIG. 3. At that point, fluid as seen by Arrows 80 would by-pass the piston in the lower portion 56 of piston 54 into that portion of bore 45 beneath the upper body portion 54 as engages the wall for the inner face of wall 42. At that point, there would be provided a fluid bleed port 86 wherein the fluid flowing via Arrows 80 would bleed out of bleed port 86 and therefore release pressure within the bore 14 of pipe 12 to prevent the rupture of the wall. Therefore, as long as there is sufficient pressure within pipe 12 to overcome the biasing of spring 66, i.e., pressure normally above 45–60 pounds per square inch, piston member would be biased away from the sealing engagement would seat 66, and therefore would allow fluid flow to by-pass piston member 56 and out through bore 86. It should be noted that because of the fluid tight engagement between the wall of piston member 54 and the wall of housing 42, any fluid flowing into bore 45, would be unable to by-pass piston 54 and enter into any portion of the bore housing spring 66. Therefore, there would be no chance of spring 66 freezing through internal water contained within that housing during use of that valve.

FIGS. 4–9 illustrate an alternate embodiment of the present invention. In those FIGURES there is seen a relief 110 is shown for placement in a fluid line (not shown) to prevent cracking or rupturing of the line when fluid in the line freezes. Relief valve 110 is a tee having a first conduit 112 for placement in the line and through which fluid flows. First conduit 112 can, for example, be a replacement section of pipe which is patched into an existing fluid line.

A second conduit 114 is in fluid communicating relationship with the interior of first conduit 112, the second conduit 114 having a cap 116 with a flat top 118 and a flat bottom 120. Cap 116 is a hollow, copper cylinder provided with internal threads 122 which mate with external threads 124 so that cap 116 sealingly engages open top 126 of second conduit 114.

Second conduit 114 extends into first conduit 112 so that flat bottom 120 is substantially coincident with the longitudinal axis of first conduit 112. Bottom 120 is also provided with a centrally disposed aperture 128 through bottom 120 for establishing fluid communication between first and second conduits 112, 114.

An annular seat 130 circumscribes aperture 128 on the face of bottom 120 that faces the interior of second conduit 114. Annular seat 130 is in the nature of a brass ring, that can alternately be made of rubber, teflon or similar materials. A brass or stainless steel piston 132 is provided in the interior of second conduit 114. Piston 132 is a generally cylindrical member having an enlarged upper portion 134 and reducted diameter portion 136 with an annularly tapered head 38 which is configured to fit in sealing relationship with annular seat 130. The outer diameter of enlarged upper portion 134 is only slightly less than the inner diameter of second conduit 114 so that the walls of second conduit 114 slidingly engage portions 134 of piston 132. Piston 132 is normally biased into a first position in sealing relationship with seat 130 during normal operation of the fluid line (e.g. 45–60) in a manner that is described below.

Figure 4:
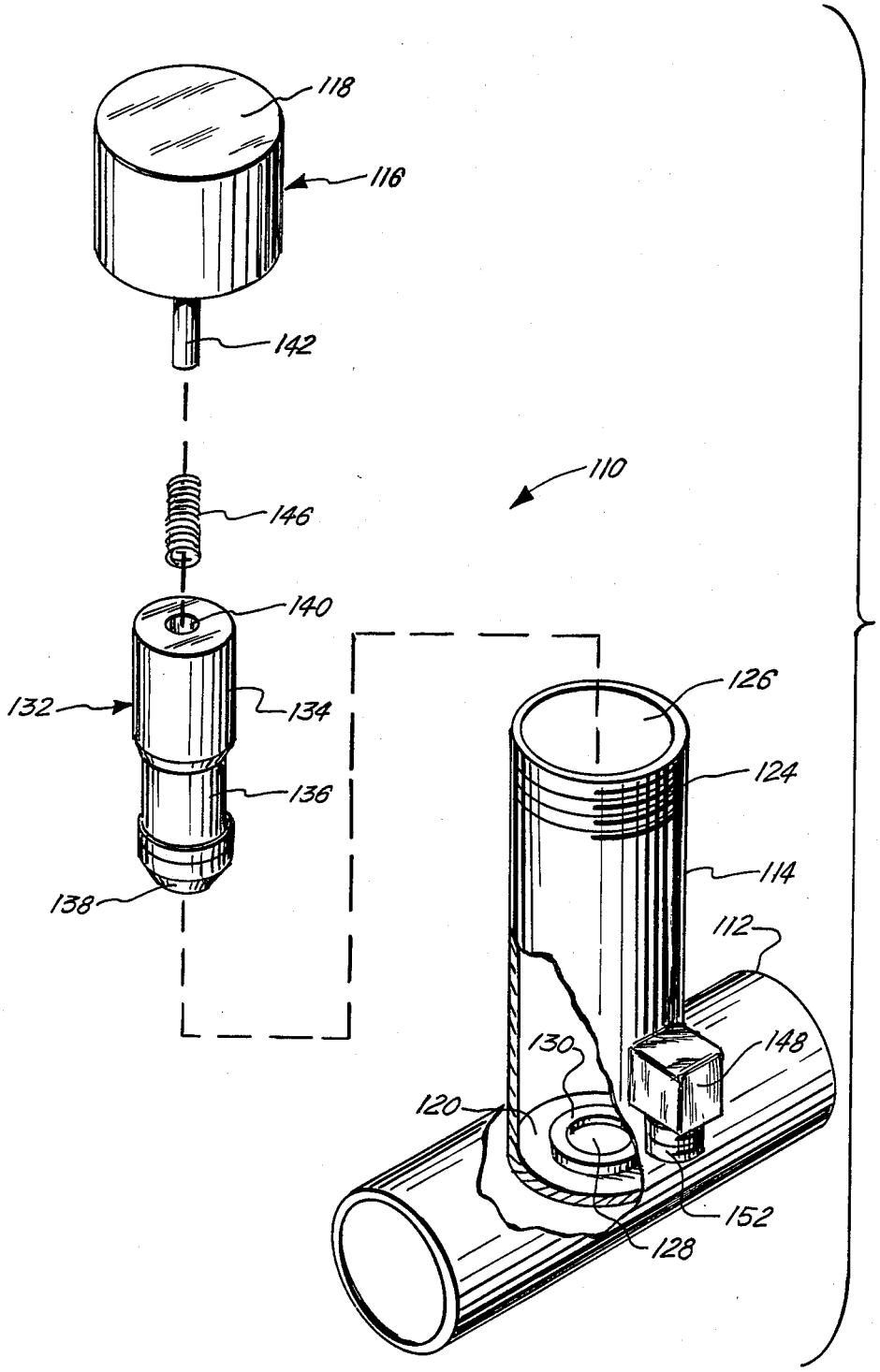
FIG. 4 is a perspective, exploded view showing a second embodiment of the relief valve of the apparatus of the present invention.
Figure 5:
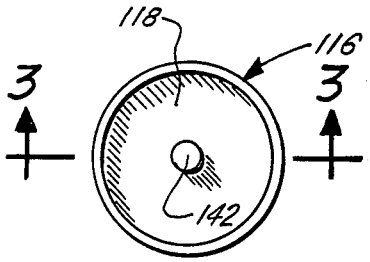
FIG. 5 is a bottom view of the cap for the relief valve of the second embodiment of the present invention.
Figure 7:
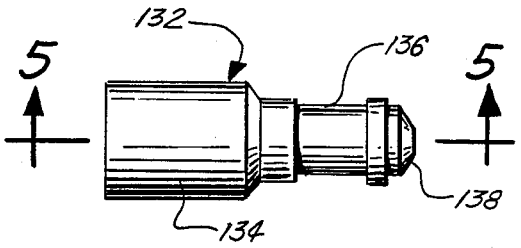
FIG. 7 is a side view of the piston of the valve shown in FIG. 4 of the second embodiment of the present invention.
Figure 6:
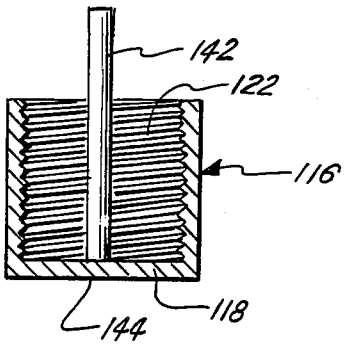
FIG. 6 is a cross-sectional view taken along section lines 3—3 of FIG. 4 of the second embodiment of the present invention.
Figure 8:
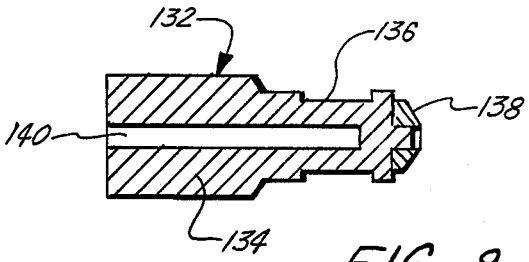
FIG. 8 is a cross-sectional view taken along section lines 5—5 of FIG. 4 of the second embodiment of the present invention.
Figure 9:
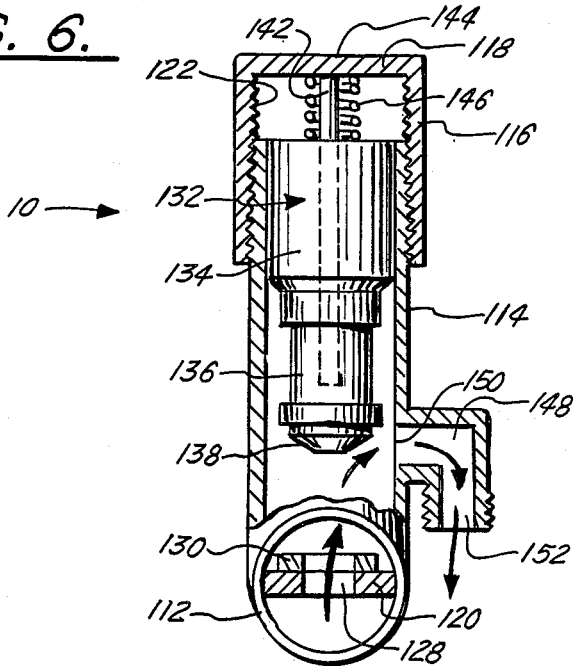
FIG. 9 is a side view, partially in cross-section, of the relief valve shown in FIG. 4 of the second embodiment of the apparatus of the present invention.

Piston 132 is provided with an internal bore 140 (FIGS. 4 and 8). A cylindrical shaft 142 is fixed at a point 144 (FIGS. 6 and 9), to an interior of flat top 118 of cap 116 on the interior of second conduit 114. Shaft 142 can be formed as an integral part of cap 116, or can be attached by such conventional means as welding. Shaft 142 is preferably longer than the length of internal bore 140 so that shaft 142 can be inserted into bore 140 with at least a portion of shaft projecting outwardly from bore 140. The shaft 142 is short enough that it does not project the entire length of bore 140, thereby permitting piston 132 to slide upwardly on shaft 142. This arrangement permits piston 132 to reciprocate on shaft 142 between its first, sealing position and a second position, shown in FIG. 9, in which it is out of sealing relationship with annular seat 130. A spring 146 circumscribes shaft 142 for normally biasing piston 132 into sealing relationship with annular seat 130, the bias of spring 146 being overcome by increased pressure within the line as fluid in the line freezes.

A dump valve line 148 is provided in fluid communicating relationship with interior of second conduit 114 to provide a drain through which fluid entering the second conduit from the first conduit can move. Dump valve line 48, is in the embodiment shown in FIGS. 4 and 9, a right angle member having an inlet port 150 (FIG. 9), through the wall of second conduit 114 adjacent aperture 128. Dump valve line 148 can be connected, for example, through its outlet port 152 to a rubber hose or other draining device (not shown). Even more conveniently, valve 110 can be positioned either inside or outside a structure so that outlet port 152 is above an existing sink or drain.

Relief valve 110 can be placed in a fluid line either inside a building or outside. If it is installed in a line on the inside of a building, this installation would typically be in the laundry area adjacent the washer drain, or positioned above a laundry sink for allowing excess fluid to drain. In order to prevent contamination of fluid in the line being protected, dump valve line 148 can be provided with a one-way flow valve (not shown).

When ambient temperature begins to fall below freezing, water in the fluid line (for example a water line) begins to freeze. This freezing begins to take place in those portions of the fluid line adjacent the walls of the conduit forming the line, while the fluid along the longitudinal axis of the line freezes last. Aperture 128 is disposed adjacent the longitudinal axis of the line where the water freezes last, and as pressure in the line increases as a result of the freezing of the water around the periphery of the line, this pressure is exerted against head 138 of piston 132 which is normally biased into sealing engagement against annular seat 130. Normal operating pressure in the fluid line could be, for example, 45–60 psi, and spring 146 could have a spring constant or adjacent tensioning means that causes piston 132 to open when a fluid pressure of 5 to 15 psi in excess of normal operating pressure is exerted against head 138. When the critical, pre-selected pressure is reached, piston 132 slides upwardly along shaft 142 against the bias of spring 146 to permit water to be drained from adjacent the longitudinal axis of first conduit 112, through aperture 128, into second conduit 114, through inlet port 150, into dump valve line 148 and out through outlet port 152.

The embodiment of the invention shown here is in the nature of a tee which is inserted into an existing fluid line by cutting out a section of the existing fluid line and inserting first conduit 112 as a replacement for the cutaway portion. It is also possible to enjoy the advantages of this invention using other specific embodiments. For example, a housing (which is similar to second conduit 114), could be inserted into a hole drilled into the existing fluid line, the junction between the housing and hole being sealed to prevent loss of fluid from the line being protected. Such a housing would have an aperture in it that is placed adjacent the longitudinal axis of the fluid line being protected. This aperture would establish fluid communicating relationship between the interior of the line and the interior of the housing. A piston and spring mechanism, similar to that described above, could then be used to provide a relief valve for draining fluid out of fluid lines from along the longitudinal axis thereof as water in the line freezes.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A relief valve for placement in a water line to prevent rupturing of the line when fluid therein freezes, the relief valve comprising:

a. a primary valve housing, with a first end positioned adjacent the wall of the fluid line;

b. a piercing member movable within the bore of the housing and having a fluid flow channel therethrough, for allowing fluid to flow into the fluid flow channel of the piercing member when the piercing member pierces through the wall of the fluid line;

c. a piston mounted in the upper portion of the piercing member and normally biased in a first fluid sealing position as fluid flows into the piercing member under non-freezing conditions;

d. bias means for normally biasing the piston member in the first fluid sealing position under the non-freezing fluid flow;

e. means for overcoming the biasing of the piston as fluid within the line freezes; and f. means for preventing fluid from contacting the bias means.

2. The relief valve of claim 1, further comprising a valve seat on the interior of the piercing member for positioning the piston member in the fluid sealing relationship with the flow bore.

3. The relief valve of claim 1, further comprising a relief port in the wall of the piercing member in the housing for allowing fluid to flow therethrough when the piston member has been moved to the second fluid flow position.

4. A relief valve in claim 1, wherein the fluid piercing member extrudes into the interior of the flow line for receiving fluid flow into a flow bore in the piercing member.

5. The relief valve of claim 1, further comprising means on the second end of the valve housing for forcing the piercing member through the wall of the fluid flow line to its position extruding into the bore of the fluid line.

6. A relief valve for placement adjacent a water flow line to prevent rupturing of the line when fluid therein freezes, the relief valve comprising:

a. a first primary housing;

b. a second housing, having a fluid flow bore through a portion of the second housing, and a piercing member on its lower end, said second housing movable within the first housing;

c. means on the upper portion of the first housing for moving the second housing down to a position so that the piercing member pierces through the wall of the flow line into the interior of the flow line to receive fluid flow therethrough;

d. piston means within the second housing for blocking fluid flow through the fluid flow bore in the housing when the piston means is in the housing;

e. means for allowing fluid flow through the fluid flow bore in the second housing to relieve pressure within the fluid line when the fluid within the line begins to freeze; and f. means for insulating the relief valve from direct metal-to-metal contact with the exterior wall of the flow line.

7. The relief valve of claim 6, further comprising insulation means surrounding the relief valve for preventing freeze up of the relief valve during freezing ambient temperatures, including means for allowing excess fluid to flow through the insulation means during operation of the valve.

8. The relief valve of claim 6, further comprising a clamp member positionable between the relief valve and the fluid line for securly positioning the relief valve onto the exterior of the fluid line.

* * * * *